US006017419A

United States Patent [19]

Graf et al.

[11] Patent Number: 6,017,419

[45] Date of Patent: Jan. 25, 2000

[54] METHOD AND ASSEMBLY FOR STORING, TRANSPORTING AND USING A METERING SIZE PRESS ROD ASSEMBLY IN A PAPER-MAKING MACHINE

[75] Inventors: Edwin X. Graf, Menasha; James A. Eng, Appleton, both of Wis.

[73] Assignee: Voith Sulzer Paper Technology North America, Inc., Appleton, Wis.

[21] Appl. No.: 08/931,854

[22] Filed: Sep. 16, 1997

[51] Int. Cl.[7] ..... D21F 11/00

[52] U.S. Cl. ..... 162/199; 162/198; 162/135; 162/201

[58] Field of Search ..... 162/198, 199, 162/201, 263, 272, 135, 224; 118/200, 207, 208, 206, 264, 256, 444, 410, 411; 427/11, 180, 420, 391, 361; 414/147, 153, 162, 222, 266, 269

[56] References Cited

U.S. PATENT DOCUMENTS 4,192,712 3/1980 Dreher ..... 162/265

5,902,401 5/1999 Elvidge et al. ..... 118/262

*Primary Examiner*—Jose Fortuna

*Attorney, Agent, or Firm*—Taylor & Associates, P.C.

[57] ABSTRACT

A metering size press rod assembly specifically for use in a paper-making machine is stored and transported in a container and use in the paper-making machine. A plurality of metering size press rod assemblies are assembled. A storage sand transport container is provided at shipping location. The container includes a plurality of elongate openings therein. Each metering size press rod assembly is loaded into a corresponding one of the elongate openings in the container. The container is then transported to a user location, the metering size press assemblies are then sequentially and individually removed from the container, used in the paper-making machine and reloaded into the elongate openings in the container. The container with the used metering size press rod assemblies is the transported back to the shipping location.

14 Claims, 4 Drawing Sheets

METHOD AND ASSEMBLY FOR STORING, TRANSPORTING AND USING A METERING SIZE PRESS ROD ASSEMBLY IN A PAPER-MAKING MACHINE

BACKGROUND OF THE INVENTION

1. Field of the Invention

The present invention relates to paper-making machines, and, more particularly, to a method and assembly for storing, transporting and using a metering size press rod assembly for use in a paper-making machine.

2. Description of the Related Art

A liquid or viscid medium (such as sizing) may be applied to a moving surface in a paper-making machine using a metering size press rod assembly. The metering size press rod assembly may include a metering rod which is carried by a metering rod bed and positioned closely adjacent to the moving surface. The distance between the metering rod and the moving surface during operation determines the thickness of the coating which is applied to the moving surface. Typically, the metering rod bed is connected to a beam or mounting via a flexible blade. The flexible blade allows the metering rod to be moved toward and away from the moving surface using known adjustment devices, such as profile adjustment screws and a load tube. The metering rod rotates within the metering rod bed during operation. A fluid channel may be formed in the metering rod bed adjacent to the metering rod. A fluid is transported through the fluid channel during operation to lubricate, cool and/or clean the metering rod during operation.

The metering rod bed is typically manufactured from a polyurethane material which may be relatively easily physically deformed if subjected to mechanical impact forces, bending and/or higher amplitude vibrations. Moreover, the various cutouts and recesses which are used to attach with the other components carried by the metering rod bed provide relatively high stress areas during transport of the metering rod bed to a user location. The tendency to be become physically damaged is further aggravated by the fact that the metering rod bed may extend, e.g., up to 10 meters in length. It is thus necessary to support the metering rod bed along the length thereof during transport to prevent physical damage.

Because of the foregoing considerations and problems, metering size presses are conventionally sent in a disassembled state from the manufacturer to the user location. Each component is separately packaged to prevent physical damage thereto during transport to the user location. The user removes all the various components from the separate packaging at the user location and assembles the metering size press rod assembly at or near the location of the paper-making machine. This requires a considerable amount of time on the part of the end user before the metering size press rod assembly can be installed into the paper-making machine. Moreover, the assembly process must be planned in advance such that the metering size press rod assembly can be fully assembled before the metering size press rod assembly in use in the paper-making machine becomes worn. Otherwise, unnecessary down time for the paper-making machine may occur which is avoided nearly at all costs in the paper-making industry.

What is needed in the art is a method and assembly which reduces work on the part of the end user, allows the metering size press rod assemblies to be quickly and easily installed in the paper-making machine, prevents physical damage to the metering size press rod assemblies during transport to the user location, is convenient, and is cost effective.

SUMMARY OF THE INVENTION

The present invention provides a storage and transport container including a plurality of elongate openings which respectively carry a plurality of assembled metering size press rod assemblies. The assembled metering size press rod assemblies are loaded into the container, transported to a user location, used in the paper-making machine, reloaded into the container, and transported back to the shipping location.

The invention comprises, in one form thereof, a method of storing, transporting and using a metering size press rod assembly specifically for use in a paper-making machine. A plurality of metering size press rod assemblies are assembled. For each metering size press rod assembly, a metering rod is placed within a rod holding portion of a metering rod bed. The metering rod bed includes a fluid channel associated with the rod holding portion. A pair of end plates are attached to respective opposite ends of the metering rod bed. A rotational power coupling is coupled to an end of the metering rod. A storage and transport container is provided at a shipping location. The container includes a plurality of elongate openings therein. Each of the elongate openings are spaced apart from and substantially parallel to each other. Each elongate opening has a cross sectional shape which is approximately the same as a cross sectional shape of each metering size press rod assembly, and each elongate opening has a cross sectional size which is larger than a cross sectional size of each metering size press rod assembly by a predetermined clearance distance. Each metering size press rod assembly is loaded into a corresponding one of the elongate openings in the container. The container is then transported to a user location. The metering size press rod assemblies are sequentially and individually removed from the container, used in the paper-making machine, and reloaded into the elongate openings in the container. The container with the used metering size press rod assemblies is then transported back to the shipping location.

An advantage of the present invention is that the metering size press rod assemblies can be assembled before being transported to the end user, without physical damage occurring to the metering size press rod assemblies during transport.

Another advantage is that the container allows multiple metering size press rod assemblies to be transported to and from the user location, thereby reducing shipping costs.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
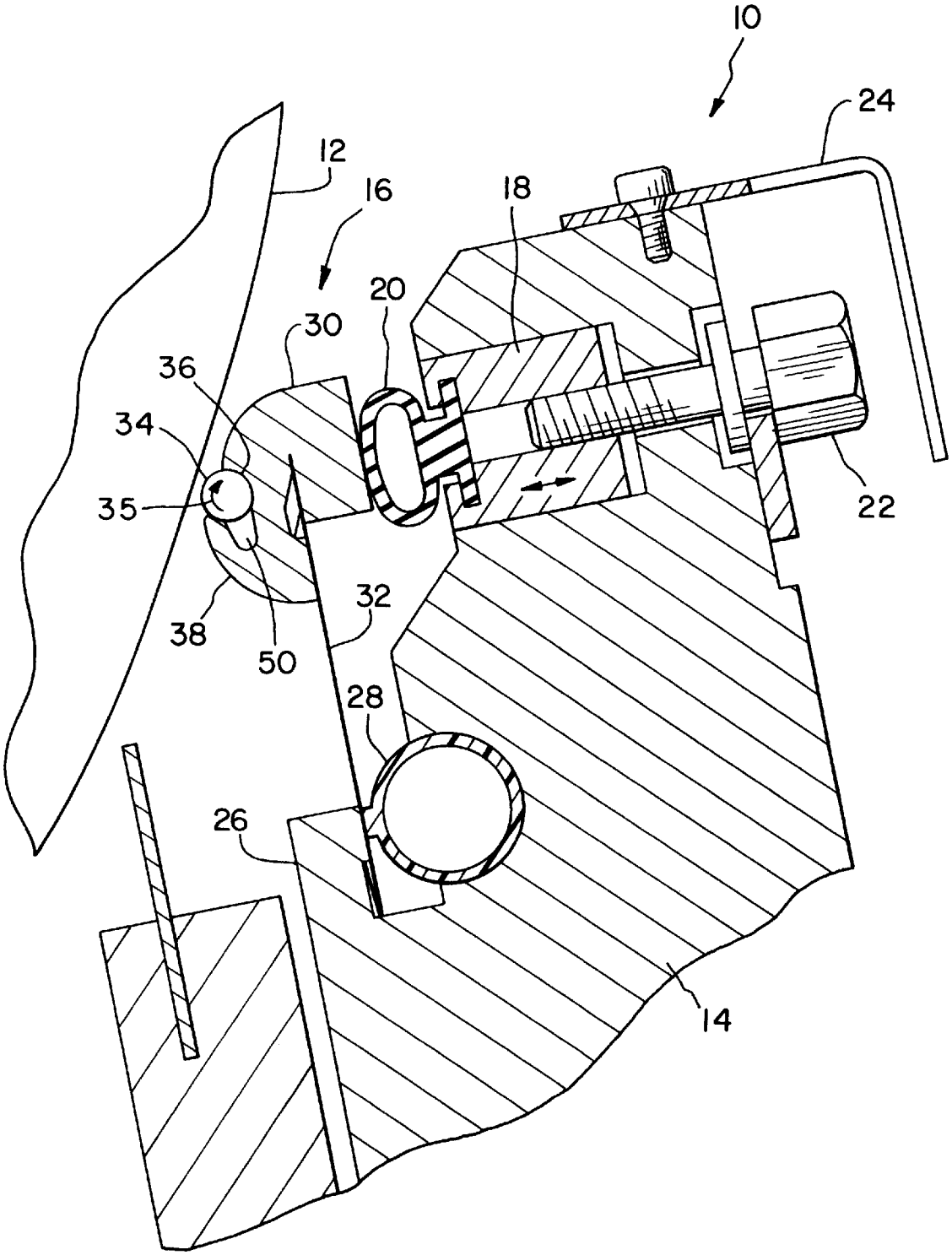
FIG. 1 is a side sectional view of an embodiment of a metering size press rod assembly in a paper-making machine which may be used with the method of the present invention.

Referring now to the drawings, there is shown an embodiment of a size press or coater 10 which is used for applying a liquid or viscid medium to a moving surface 12. Coater 10 generally includes a beam or mounting 14 and an embodiment of a metering size press rod assembly 16 with which the method of the present invention may be used. Other parts making up coater 10 include a profile bar 18, a load tube 20, a plurality of profile adjustment screws (one of which is shown and referenced as 22), a cover 24, a blade support bar 26, and a blade clamping tube 28.

Moving surface 12 is in the form of an applicator roll in the embodiment shown in FIG. 1. When configured as such it is thus apparent to those skilled in the art that coater 10 applies the liquid or viscid medium (such as sizing) on a material web (such as paper or cardboard) in an indirect manner via an intermediate application of the medium on applicator roll 12. Moving surface 12 may also be in the form of a backing roll or a fiber web. If moving surface 12 is in the form of a fiber web, it will be appreciated by those skilled in the art that coater 10 carries out a direct application of the liquid or viscid medium on moving surface 12.

Figure 2:
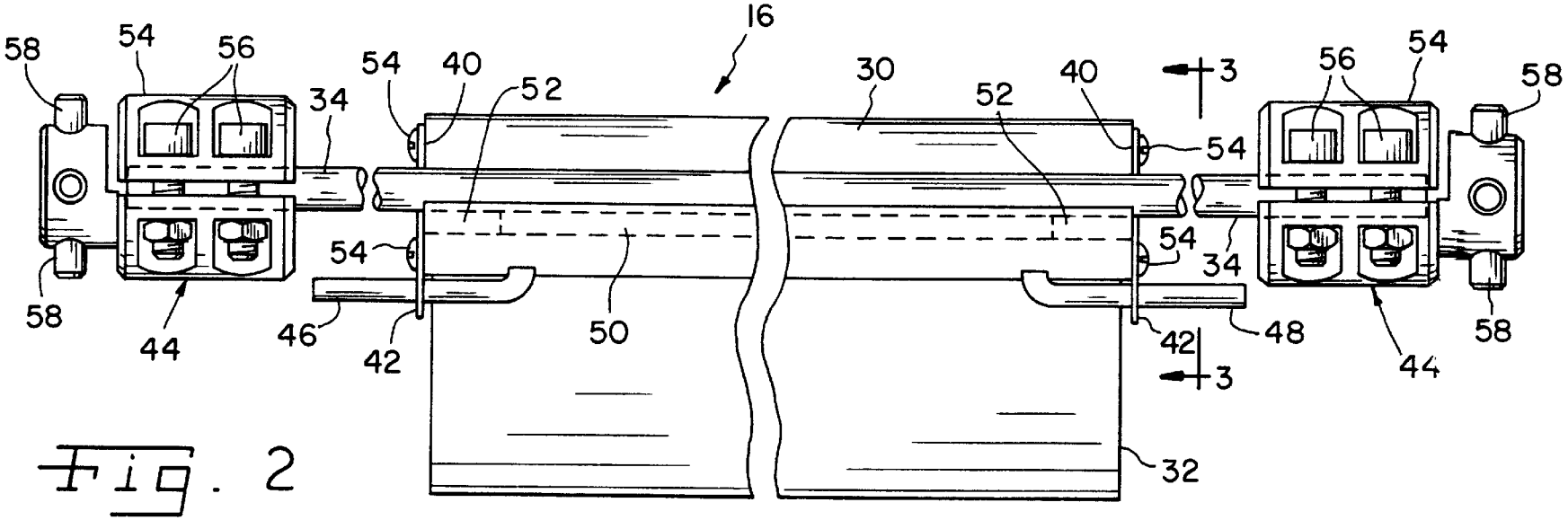
FIG. 2 is a front view of the metering size press rod assembly shown in FIG. 1.
Figure 3:
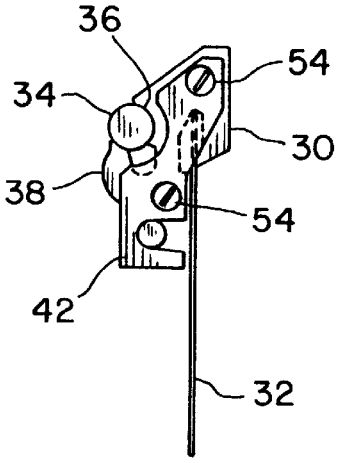
FIG. 3 is a sectional view of the metering size press rod assembly shown in FIGS. 1 and 2, taken along line 3—3 in FIG. 2.

Metering size press rod assembly 16 (FIGS. 1–3) generally includes a metering rod bed 30, a flexible blade 32, a metering rod 34, a pair of end plates 42, a pair of rotational power couplings 44, an inlet pipe 46 and an outlet pipe 48.

Metering rod bed 30 is connected to mounting 14 via a flexible blade 32. More particularly, blade 32 is clamped near one end thereof between blade clamping tube 28 and blade support bar 26. An opposing end of blade 32 is received within metering rod bed 30. Metering rod bed 30 also includes a pair of opposite ends 40.

Metering rod 34 is carried by metering rod bed 30. In the embodiment shown in FIGS. 1–3, metering rod 34 has a substantially circular cross section and is disposed adjacent to moving surface 12. Metering rod 34 extends in a direction corresponding to the width of moving surface 12 (i.e., generally perpendicular to the drawing of FIG. 1) and is driven in a rotational direction by a driver (not shown), as indicated by arrow 35. With reference to FIG. 1, metering rod 34 appears to be in direct contact with moving surface 12. However, it will be appreciated that during operation a small gap likely exists between metering rod 34 and moving surface 12, corresponding to the thickness of the medium being applied.

In the embodiment shown, metering rod bed 30 includes a contoured surface 36 having a shape which is approximately the same as the peripheral shape of metering rod 34, and receives a portion of the periphery of metering rod 34 therein. Metering rod bed 30 also includes a hooked member 38 having a distal end which engages metering rod 34 and biases metering rod 34 against contoured surface 36. Contoured surface 36 and hooked member 38 together define a rod holding portion for holding metering rod 34.

Metering rod bed 30 also includes a fluid channel 50 which is associated with the rod holding portion defined by contoured surface 36 and hooked member 38. Fluid channel 50 allows lubricating and/or cooling fluid to be transported therethrough for lubricating, cooling and cleaning metering rod 34. A pair of seals or plugs 52 are inserted in fluid channel 50, with each plug 52 being positioned adjacent to a respective end 40 of metering rod bed 30. Plugs 52 substantially seal the ends of fluid channel 50 and thereby prevent the fluid from flowing out of the ends of fluid channel 50. Inlet pipe 46 and outlet pipe 48 are each carried by metering rod bed 30, and disposed in fluid communication with fluid channel 50. The fluid is transported through inlet pipe 46 to fluid channel 50, and is transported from fluid channel 50 to outlet pipe 48. Inlet pipe 46 is preferably disposed in fluid communication with one end of fluid channel 50, and outlet pipe 48 is preferably disposed in fluid communication with the opposite end of fluid channel 50, as shown. A pair of end plates 42 are respectively attached to opposite ends 40 of metering rod bed 30 using, e.g., respective pairs of screws 54.

Rotational power couplings 44 are respectively coupled to opposite ends of metering rod 34. More particularly, rotational power couplings 44 each include a clamp portion in the form of split clamping halves which are clamped around the respective end of metering rod 34 using four bolts 56, two on each side of metering rod 34. Each rotational power coupling 44 also includes a plurality of radially extending lugs 58 which interconnect with a rotational power drive (not shown). In the embodiment shown, each rotational power coupling 44 includes four radially extending lugs 58; however, each rotational power coupling 44 may include a different number of lugs 58.

Figure 4:
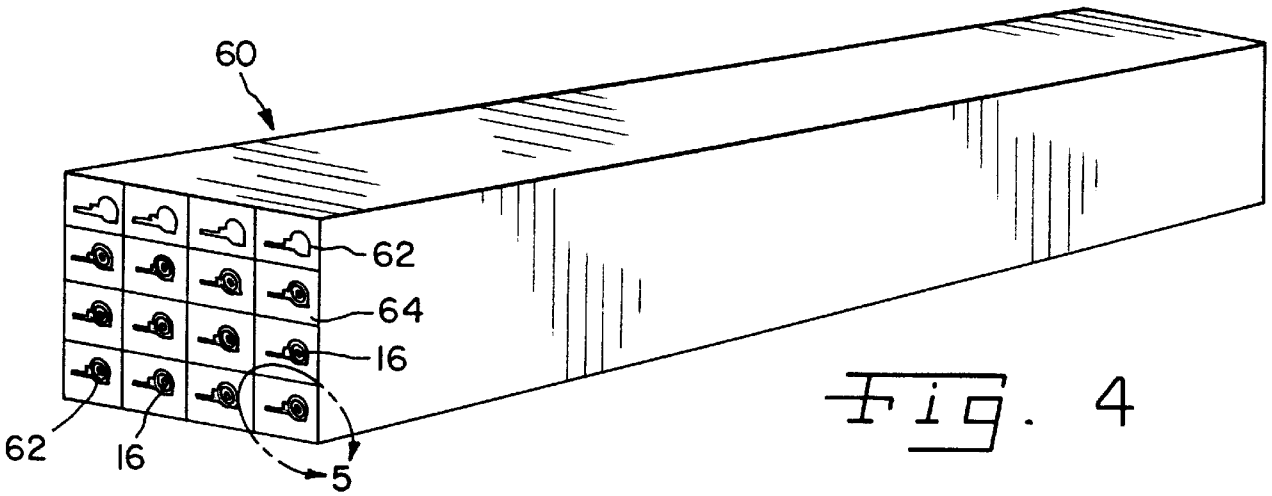
FIG. 4 is a perspective view of an embodiment of a storage and transport container which may be used with the method of the present invention, with a number of metering size press rod assemblies as shown in FIGS. 1–3 loaded therein.
Figure 5:
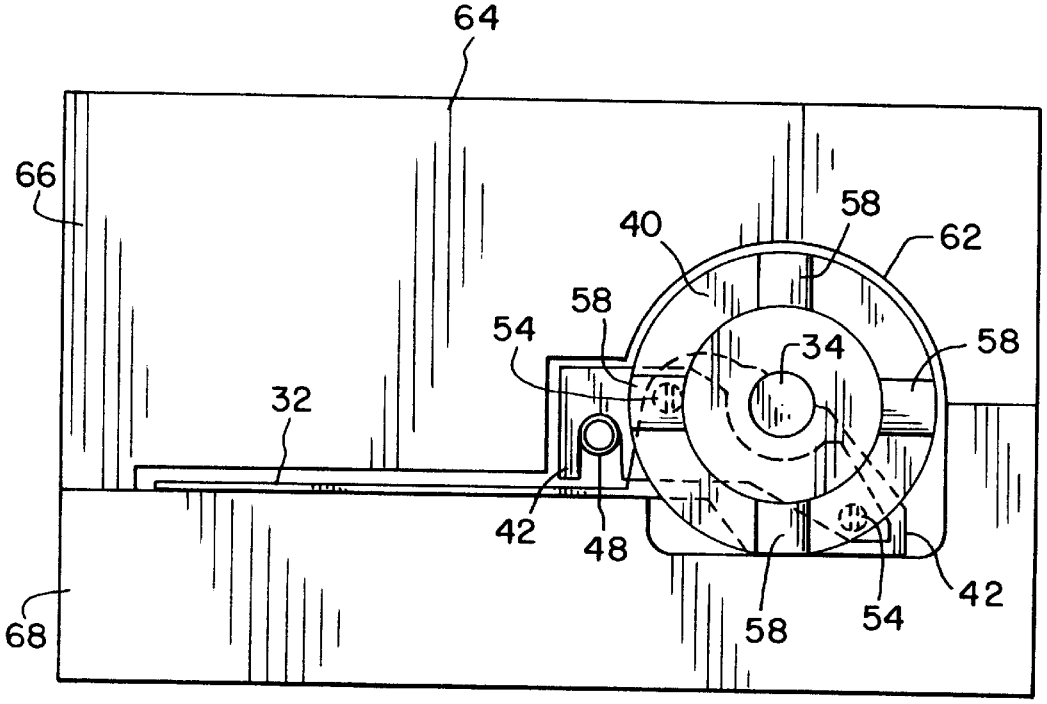
FIG. 5 is an enlarged, partial end view of the container shown in FIG. 4, taken at detail line 5.

Referring now to FIGS. 4 and 5, there is shown an embodiment of a storage and transport container 60 of the present invention, with which the method of the present invention may be utilized. Container 60 includes a plurality of elongate openings 62 therein. Each elongate opening 62 extends substantially the length of container 60, and receives a corresponding metering size press rod assembly 16 therein. The elongate openings 62 are spaced apart from and substantially parallel to each other within container 60. In the embodiment shown in FIG. 4, the container 60 includes four rows and four columns of elongate openings, as viewed from an end of container 60. The elongate openings 62 in the top row are shown empty, while in the elongate openings 62 in the bottom three rows are shown with metering size press rod assemblies 16 loaded therein. Each elongate opening 62 is shown as being disposed within a cell 64 indicated by intersecting lines in FIG. 4. Each indicated cell 64 may correspond to a separately formed elongate portion in which the individual elongate opening 62 is cut or otherwise formed. For example, referring to FIG. 5, each cell may be formed from a top half 66 and bottom half 68 which are glued together to define an elongate opening 62. The individual cells are then glued or otherwise fastened together to define container 60. Of course, it will also be appreciated that it may be possible to form container 60 from a monolithic block of material in which elongate opening 62 are formed. Moreover, container 60 may be configured with rollers and handles at each end (not shown) allowing ease of movement.

Each elongate opening 62 in container 60 has a cross-sectional shape which is approximately the same as the projected cross-sectional shape of each metering size press rod assembly 16. That is, each elongate opening 62 has a cross sectional shape which corresponds to the cross-section of a metering size press rod assembly 16 as viewed from an end of the metering size press rod assembly 16. Moreover, each elongate opening 62 has a cross sectional size which is larger than the projected cross-sectional size of each metering size press rod assembly 16 by a predetermined clearance distance. By providing each elongate opening 62 with a cross-sectional shape which is approximately the same as the projected cross-sectional shape of each metering size press rod assembly 16, and by also providing a proper clearance distance between the metering size press rod assembly 16 and elongate opening 62, each metering size pres 16 may be carried within container 60 without substantial jostling during transport. Thus, the cross-sectional shape and clearance distance associated with each elongate opening allow metering size press rod assemblies 16 to be relatively easily slid therein, while at the same time preventing physical damage to metering size press rod assemblies 16 during transport.

The bottom half of each elongate opening 62 is formed with a portion which supports flexible blade 32 at the underside thereof substantially along the length of blade 32. By supporting a portion of blade 32 which is relatively closely adjacent to metering rod 34, indirect support can be provided to metering rod 34 and metering rod bed 30 in a vertical direction. This in turn prevents flexing and vibration of metering rod bed 30 and metering rod 34 in vertically upwards and downward directions during transport. Supporting substantially the entire underside of blade 32 thus assists in preventing physical damage to metering size press rod assembly 16 during transport.

In the embodiment shown, each cell within container 16 is constructed from an energy absorbing material in the form of polystyrene which at least partially surrounds and supports each corresponding metering size press rod assembly 16. The energy absorbing material is selected to structurally support metering size press rod assembly 16, while at the same time absorb and dissipate impact forces against the metering size press rod assembly 16 which may be caused by bouncing of container 60 during transport.

Figure 6:
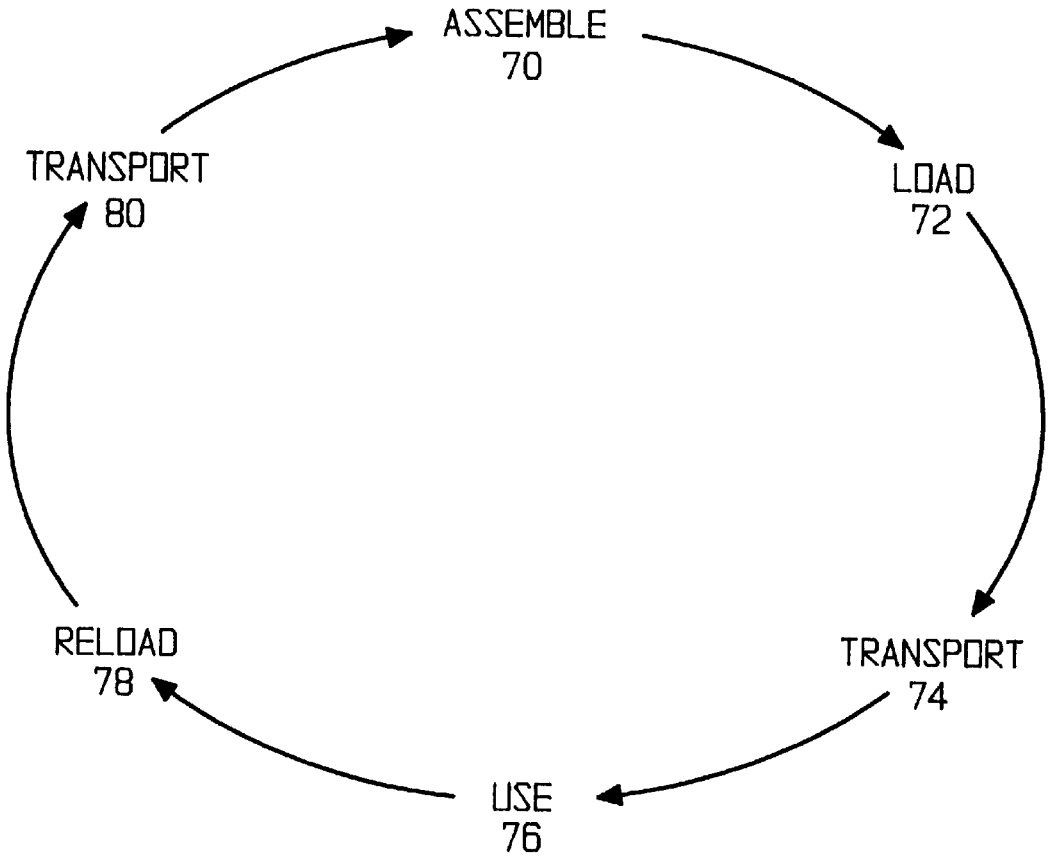
FIG. 6 is a graphical depiction of the method of the present invention, utilizing the metering size press rod assembly shown in FIGS. 1–3 and the container shown in FIGS. 4–5.

Referring now to FIG. 6, there is shown a graphical illustration of an embodiment of the method of the present invention for storing, transporting and using a metering size press rod assembly in a paper-making machine. For purposes of illustration, it is assumed that the method illustrated in FIG. 6 is carried out using metering size press rod assemblies 16 and container 60 shown in FIGS. 1–5.

In contrast with conventional metering size press rod assemblies which are shipped as individual components to the end user and assembled at the site of the paper-making machine, the present invention provides a storage and transport assembly, including metering size press rod assemblies 16 and container 60, which allows a plurality of metering size press rod assemblies 16 to be assembled by the manufacturer and transported to the user location without physical damage occurring to the metering size press rod assemblies during transport. Each metering size press rod assembly is assembled (step 70) by assembling the metering rod bed 30, metering rod 34, plugs 52, end plates 42, inlet pipe 46, outlet pipe 48, flexible blade 32 and rotational power couplings 44 as described above. Thereafter, the plurality of metering size press rod assemblies 16 are loaded into transport container 60 by placing each metering size press rod assembly 16 within a corresponding elongate opening 62 (step 72). Container 60, with the plurality of metering size press rod assemblies 16 therein, is then transported to the user location using any convenient mode of transportation (step 74). The shipping location is broadly intended to mean the location at which metering size press rod assemblies 16 are loaded into container 60. Of course, it will be appreciated that container 60, with metering size press rod assembly 16 therein, may be delayed or stopped along the transportation path to the user location. When at the user location (e.g., the location of the paper-making machine), a metering size press rod assembly 16 is removed from container 60 and installed in the paper-making machine for use (step 76). After being worn a predetermined amount, the metering size press rod assembly 16 is then removed from the paper-making machine. A new metering size press rod assembly 16 is then removed from container 60 and installed in the paper-making machine, and the used metering size press rod assembly 16 is reloaded into an empty elongate opening 62 in container 60. This process of removing a metering size press rod assembly 16, using the metering size press rod assembly 16 until worn, and replacing the used metering size press rod assembly in container 60 repetitively occurs until all the metering size press rod assemblies 16 which were transported to the user location are used (steps 76 and 78). The container with the used metering size press rod assemblies is then transported back to the shipping location (step 80). The metering size press rod assemblies are then removed from container 60 and rebuilt or replaced (step 70). The method of storing, transporting and using the metering size press rod assembly 16, in conjunction with container 60, then repeats.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of storing, transporting and using a metering size press rod assembly in a paper-making machine, said method comprising the sequential steps of:

assembling a plurality of metering size press rod assemblies, said assembling step for each said metering size press rod assembly including the non-sequential sub-steps of:

placing a metering rod within a rod holding portion of a metering rod bed, said metering rod bed including a fluid channel associated with said rod holding portion;

attaching a pair of end plates to respective opposite ends of said metering rod bed; and coupling a rotational power coupling to an end of said metering rod;

providing a storage and transport container at a shipping location, said container including a plurality of elongate openings therein, each of said elongate openings being spaced apart from and substantially parallel to each other, each said elongate opening having a cross sectional shape which is approximately the same as a cross sectional shape of each said metering size press rod assembly, and each said elongate opening having a cross sectional size which is larger than a cross sectional size of each said metering size press rod assembly by a predetermined clearance distance;

loading each said metering size press rod assembly into a corresponding one of said elongate openings in said container;

transporting said container to a user location;

sequentially and individually removing said metering size press rod assemblies from said container, using said metering size press rod assemblies in said paper-making machine, and reloading said used metering size press rod assemblies in said elongate openings in said container; and transporting said container with said used metering size press rod assemblies back to said shipping location.

2. The method of claim 1, wherein said assembling step comprises the further non-sequential sub-steps of:

inserting a pair of plugs in said fluid channel, each said plug being positioned adjacent a respective said end of said metering rod bed;

coupling a second rotational power coupling to an opposite end of said metering rod;

attaching a flexible blade to said metering rod bed; and connecting an inlet pipe and an outlet pipe to said metering rod bed, each of said inlet pipe and said outlet pipe being in fluid communication with said fluid channel.

3. The method of claim 1, wherein said clearance distance associated with each said elongate opening is sized large enough to define a means for allowing a respective said metering size press rod assembly to be slid therein, and is sized small enough to define a means for preventing physical damage to a respective said metering size press rod assembly during said transporting steps.

4. The method of claim 1, wherein said container is comprised of an energy absorbing material which at least partially surrounds and supports each said metering size press rod assembly.

5. The method of claim 4, wherein said energy absorbing material comprises a plastic.

6. The method of claim 5, wherein said plastic comprises polystyrene.

7. A method of storing, transporting and using a metering size press rod assembly in a paper-making machine, said method comprising the sequential steps of:

assembling a plurality of metering size press rod assemblies, said assembling step for each said metering size press rod assembly including the sub-steps of:

placing a metering rod within a rod holding portion of a metering rod bed, said metering rod bed including a fluid channel associated with said rod holding portion; and attaching a pair of end plates to respective opposite ends of said metering rod bed;

providing a storage and transport container at a shipping location, said container including a plurality of elongate openings therein, each of said elongate openings being spaced apart from and substantially parallel to each other, each said elongate opening having a cross sectional shape which is approximately the same as a projected cross sectional shape of each said metering size press rod assembly, and each said elongate opening having a cross sectional size which is larger than a cross sectional size of each said metering size press rod assembly by a predetermined clearance distance;

loading each said metering size press rod assembly into a corresponding one of said elongate openings in said container;

transporting said container to a user location;

sequentially and individually removing said metering size press rod assemblies from said container, using said metering size press rod assemblies in said paper-making machine, and reloading said used metering size press rod assemblies in said elongate openings in said container; and transporting said container with said used metering size press rod assemblies back to said shipping location.

8. The method of claim 7, wherein said assembling step comprises the further non-sequential sub-steps of:

inserting a pair of plugs in said fluid channel, each said plug being positioned adjacent a respective said end of said metering rod bed;

coupling a pair of rotational power couplings to respective opposite ends of said metering rod;

attaching a flexible blade to said metering rod bed; and connecting an inlet pipe and an outlet pipe to said metering rod bed, each of said inlet pipe and said outlet pipe being in fluid communication with said fluid channel.

9. The method of claim 7, wherein said clearance distance associated with each said elongate opening is sized large enough to define a means for allowing a respective said metering size press rod assembly to be slid therein, and is sized small enough to define a means for preventing physical damage to a respective said metering size press rod assembly during said transporting steps.

10. The method of claim 7, wherein said container is comprised of an energy absorbing material which at least partially surrounds and supports each said metering size press rod assembly.

11. The method of claim 10, wherein said energy absorbing material comprises a plastic.

12. The method of claim 11, wherein said plastic comprises polystyrene.

13. A method of storing, transporting and using a metering size press rod assembly in a paper-making machine, said method comprising the sequential steps of:

assembling a plurality of metering size press rod assemblies, said assembling step for each said metering size press rod assembly including the sub-step of placing a metering rod within a rod holding portion of a metering rod bed;

providing a storage and transport container at a shipping location, said container including a plurality of elongate openings therein, each of said elongate openings being spaced apart from and substantially parallel to each other, each said elongate opening having a cross sectional shape which is approximately the same as a cross sectional shape of each said metering size press rod assembly, and each said elongate opening having a cross sectional size which is larger than a cross sectional size of each said metering size press rod assembly by a predetermined clearance distance;

loading each said metering size press rod assembly into a corresponding one of said elongate openings in said container;

transporting said container to a user location;

sequentially and individually removing said metering size press rod assemblies from said container, using said metering size press rod assemblies in said paper-making machine, and reloading said used metering size press rod assemblies in said elongate openings in said container; and transporting said container with said used metering size press rod assemblies back to said shipping location.

14. The method of claim 13, wherein said assembling step comprises the further non-sequential sub-steps of:

attaching a pair of end plates to respective opposite ends of said metering rod bed; and coupling a rotational power coupling to an end of said metering rod.

* * * * *